US005879182A

United States Patent [19]

Abe

[11] Patent Number: 5,879,182

[45] Date of Patent: Mar. 9, 1999

[54] INSULATION PIERCING TERMINAL

[75] Inventor: Kimihiro Abe, Haibara-gun, Japan

[73] Assignee: Yazaki Corporation, Tokyo, Japan

[21] Appl. No.: 914,211

[22] Filed: Aug. 19, 1997

[30] Foreign Application Priority Data

Sep. 3, 1996 [JP] Japan ..... 8-233372

[51] Int. Cl.[6] ..... H01R 4/24

[52] U.S. Cl. ..... 439/397; 439/399

[58] Field of Search ..... 439/397, 398, 439/394, 400, 406, 407

[56] References Cited

U.S. PATENT DOCUMENTS 4,948,382 8/1990 Marpoe, Jr. et al. ..... 439/397
5,591,044 1/1997 Abe et al. ..... 439/397

FOREIGN PATENT DOCUMENTS 62-193067 8/1987 Japan .

*Primary Examiner*—Neil Abrams
*Assistant Examiner*—Antoine Ngandjui
*Attorney, Agent, or Firm*—Sughrue, Mion, Zinn, Macpeak & Seas, PLLC

[57] ABSTRACT

An insulation piercing terminal is so designed that a piece of thin metal plate is pressed in such a manner that an insulation piercing plate having a pair of right and left insulation piercing blades each pair of which defines an insulation piercing slot, is bent raised against a belt-shaped bottom plate which is extended in a front-to-rear direction, and the pair of insulation piercing blades are located near the bending lines. In the insulation piercing terminal, reinforcing walls are provided at both ends of each of the bending lines to prevent the insulation piercing blades from being displaced when the wire is pushed therein.

9 Claims, 4 Drawing Sheets

INSULATION PIERCING TERMINAL

BACKGROUND OF THE INVENTION

This invention relates to an insulation piercing terminal which is so designed that a covered wire is pushed in between insulation piercing blades whereby the conductor of the wire is connected to the insulation piercing terminal without removal of the insulating sheath of the wire.

FIG. 1 is a perspective view showing a conventional insulation piercing terminal which has been disclosed by Japanese Patent Unexamined Publication No. 193067/1987.

In the conventional insulation piercing terminal, parts of a bottom substrate 2 are cut and bent upwardly to form a pair of insulation piercing plates 3, each of which comprises a pair of insulation piercing blades 11 which defines an insulation piercing slot 12. The pair of insulation piercing plates 3 are set close to each other, to provide insulation piercing pieces 10.

A wire is connected to the insulation piercing terminal 1 as follows: That is, the wire is pushed in the insulation piercing slots 12 from above. As a result, the insulation piercing blades 11 cut the insulating sheath of the wire, and contact the conductor of the wire. When the wire is further pushed in, the conductor of the wire is moved into a space between the right and left insulation piercing blades, so that the conductor is more positively held by the right and left insulation piercing blades 11. In this operation, a force acts to move the crimping plates 3 in opposite directions along a longitudinal axis of the bottom substrate 2.

In general, an insulation piercing terminal is mass-produced, and a number of insulation piercing terminals are built in a connector housing in such a manner that they are adjacent to one another. Hence, there has been a strong demand for the provision of an insulation piercing terminal which is small in size, and light in weight. In order to decrease the weight of the insulation piercing terminal, it is essential to reduce the thickness of a metal plate which is formed into the insulation piercing terminal. In addition, in order to miniaturize the insulation piercing terminal, it is necessary to decrease the width and the length of the insulation piercing terminal. For instance, in order to decrease the width of the insulation piercing terminal, it is essential to decrease the width of the insulation piercing blades forming the insulation piercing slot.

However, if the thickness of the metal plate, which is a raw material for the insulation piercing terminal, is decreased, or if the width of the insulation piercing blades is decreased, then the mechanical strength of the insulation piercing blades is also decreased. As a result, when the wire is pushed in the insulation piercing slot, it acts to move at least one of the insulation piercing plates 3 along a longitudinal axis of the bottom substrate 2.

In the conventional insulation piercing terminal 1, stress concentrates at the bending lines of the roots of the insulation piercing blades 11, so that at least one of the insulation piercing blades 11 move along a longitudinal axis of the bottom substrate 2. This difficulty relates to the fact that the thickness of the insulation piercing plate is decreased by the aforementioned bending operation.

SUMMARY OF THE INVENTION

Accordingly, it is an object of the invention to eliminate the above-described difficulties accompanying a conventional insulation piercing terminal.

More specifically, it is an object of the invention to provide an insulation piercing terminal which is miniaturized, and when the wire is pushed therein, the insulation piercing blades are prevented from being displaced; that is, to improve the reliability in electrical connection of the insulation piercing terminal.

The foregoing object and other objects of the invention have been achieved by the provision of an insulation piercing terminal formed by pressing a piece of thin metal plate comprising:

An insulation piercing terminal formed by pressing a piece of thin metal plate comprising:

a bottom plate extended in a longitudinal direction;

an insulation piercing plate connected to said bottom plate, said insulation piercing plate having right and left insulation piercing blades which are bent along a bending line against said bottom plate; and reinforcing walls provided at both ends of said bending line to prevent said right and left insulation piercing blades from being displaced.

With the insulation piercing terminal, when a wire is pushed in the insulation piercing slots, force acts to move at least one of the insulation piercing plates 3 along a longitudinal axis of the bottom substrate 2. However, because the reinforcing walls are provided at both ends of the bending line near the insulation piercing blades; that is, the roots of the insulation piercing blades are reinforced, the insulation piercing blades are prevented from being bent in a direction along the longitudinal axis of the bottom substrate.

In the above-mentioned insulation piercing terminal, as a second aspect of the present invention, each of the reinforcing walls includes a flat surface portion which is formed at both ends of the bending line by punching.

In the insulation piercing terminal according to the second aspect of the present invention, flat surface portions are formed at both ends of each of the bending lines by punching, to reinforce the roots of the insulation piercing blades.

Furthermore, in the above-mentioned insulation piercing terminal, as a third aspect of the present invention, each of the reinforcing walls includes a flat surface portion which is oblique with respect to the insulation piercing plate and the belt-shaped bottom plate by punching.

In the insulation piercing terminal according to the third aspect of the present invention, the corners (both ends) of the insulation piercing plate and the bottom plate are punched oblique to form the flat portions; that is, small side-wall-like reinforcing walls are formed between the insulation piercing plate and the bottom plate in such a manner that the insulation piercing plate and the bottom plate are connected through the reinforcing walls to each other, which reinforces the roots of the insulation piercing blades.

Moreover, the foregoing object and other objects of the invention have been achieved by the provision of an insulation piercing terminal, according to a fourth aspect of the present invention, comprising:

an elongated substrate having one edge portion from which a bottom plate is extended;

an electrical contact section connected to the front end portion of the substrate in a longitudinal direction for engaging with a mating terminal; and a cramping plate connected to the rear end portion of the substrate in the longitudinal direction for cramping a wire;

wherein the bottom plate is folded over the substrate, a pair of insulation piercing plates are respectively connected to the longitudinal ends of the bottom plate, each of the insulation piercing plates is provided with right and left insulation piercing blades so as to define an insulation piercing slot therebetween, each of the insulation piercing plates is bent raised along a bending line against the bottom plate so as to form an insulation piercing conductive section between the electrical contact section and the wire cramping section, and reinforcing walls are provided at both ends of the bending line to prevent the right and left insulation piercing blades from being displaced.

In the insulation piercing terminal according to the fourth aspect of the invention, the bottom plate forming the insulation piercing conductive section is laid on the substrate which is extended over the electrical contact section, the insulation piercing conductive section, and the wire cramping section. Hence, on the common substrate, the electrical contact section, the insulation piercing conductive section and the wire cramping section are formed.

In addition, in the insulation piercing terminal according to the fourth aspect of the present invention, as a fifth aspect of the present invention, the substrate is provided with a support plate which is extended from the other edge thereof and is bent upwardly to form a side wall of the insulation piercing conductive section, and the support plate defining the side wall is formed with grooves which are engaged with the side edges of the insulation piercing plates.

In the insulation piercing terminal according to the fifth aspect of the present invention, the grooves formed in the side wall of the insulation piercing conductive section are engaged with the side edges of the insulation piercing plates, which prevent the insulation piercing plates from falling aside.

The nature, utility and principle of the invention will be more clearly understood from the following detailed description and the appended claims when read in conjunction with the accompanying drawings.

DETAILED DESCRIPTION OP THE INVENTION

A preferred embodiment of an insulation piercing terminal according to the present invention will be described with the accompanying drawings.

The insulation piercing terminal of the invention will be described with reference to FIGS. 3(*a*)–3(*c*).

Figure 3:
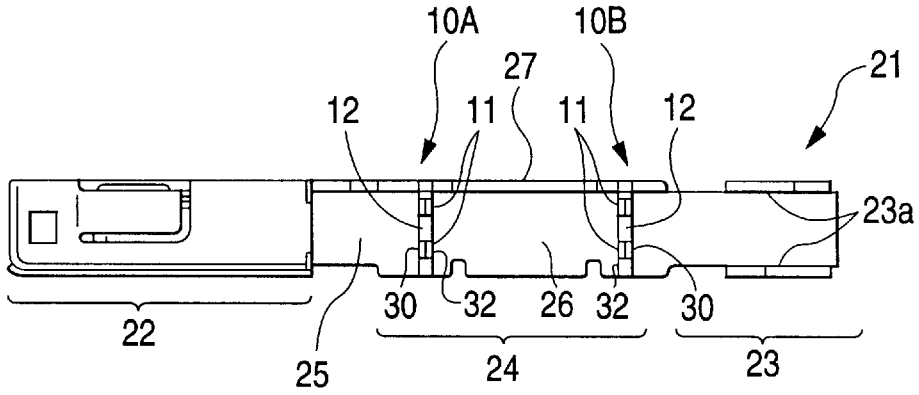
FIGS. 3(*a*)–3(*c*) show the whole arrangement of the insulation piercing terminal according to the invention — more specifically, FIGS. 3(*a*) and 3(*b*) are a plan view and a side view of the insulation piercing terminal, respectively, and FIG. 3(*c*) is a sectional view taken along line IIIc—IIIc of FIG. 3(*b*)
Figure 3:
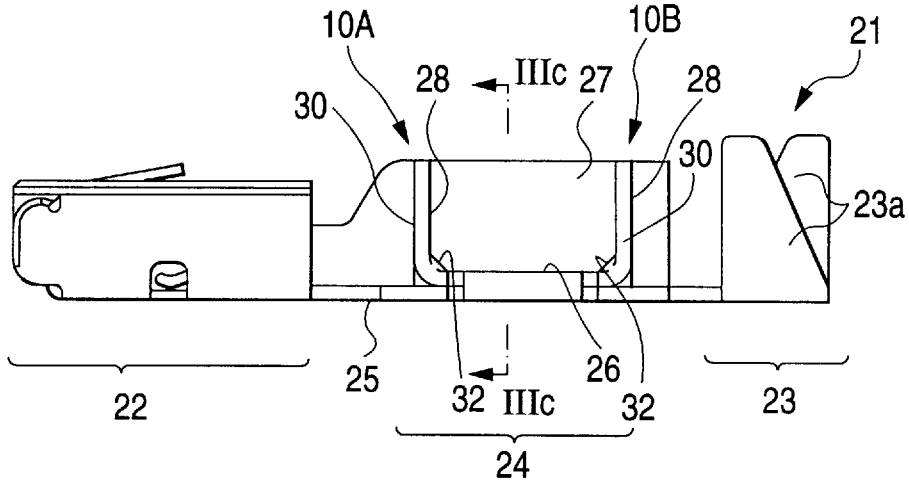
Figure 3:
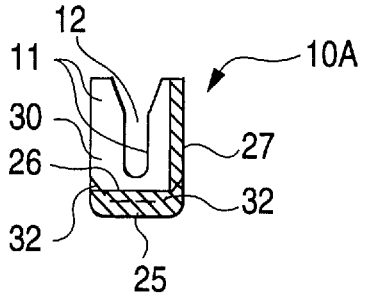

In FIGS. 3(*a*)–3(*c*), reference numeral 21 designates the insulation piercing terminal. The insulation piercing terminal 21 is formed by blanking a piece of thin metal plate as shown in FIGS. 3(*a*)–3(*c*). The front end portion of the insulation piercing terminal is an electrical contact section 22 which is engaged with a mating terminal, the rear end portion is a wire cramping section 23, and the middle portion between those front and rear end portions is an insulation piercing conductive section 24. Those sections 22, 24, and 23 have a common substrate 25.

The electrical contact section 22 is provided to engage with the mating terminal, to electrically connect itself (the insulation piercing terminal) to the mating terminal. The electrical contact section 22 is in the form of a box. The wire cramping section 23 is provided to hold a wire by the insulating sheath of the wire. The wire cramping section 23 is U-shaped in section, having a part of the substrate 25, and a pair of retaining pieces 23*a*. The insulation piercing conductive section 24 is provided to electrically contact the conductor of the wire, and has a pair of insulation piercing pieces 10A and 10B.

Figure 4:
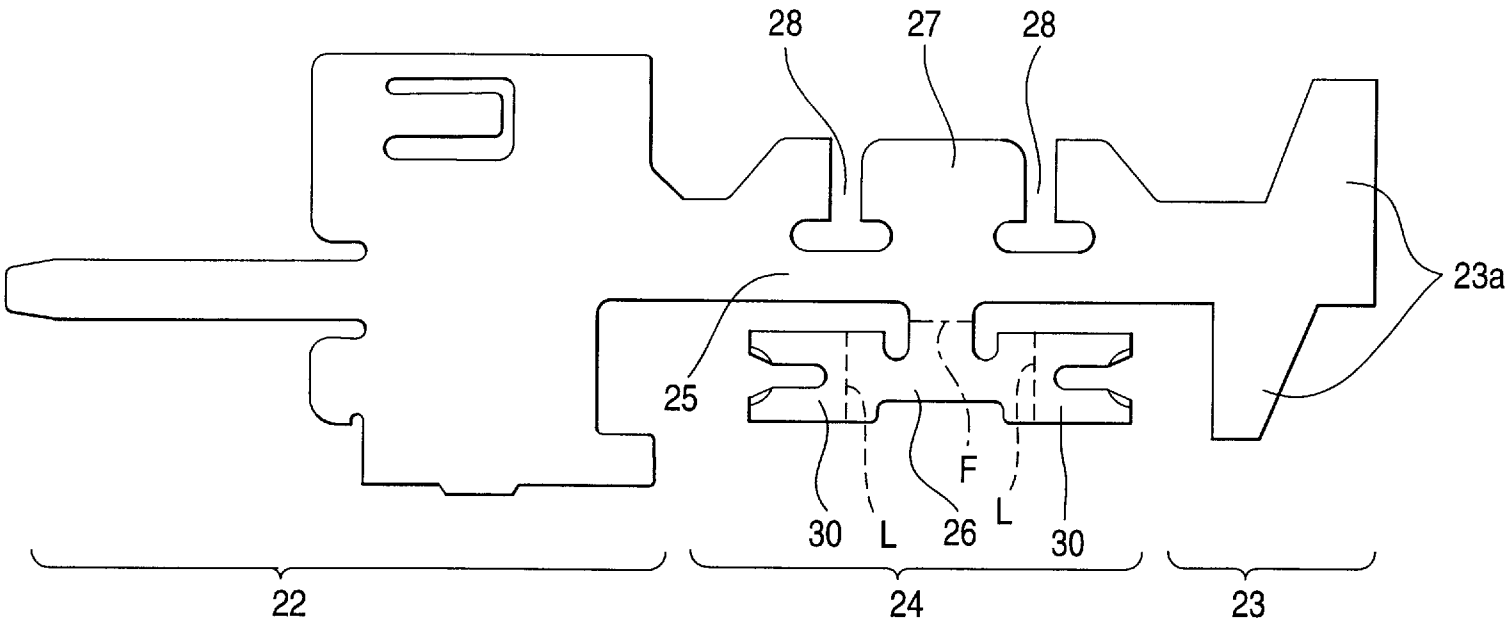
FIG. 4 is a diagram of the unfolded insulation piercing terminal according to the invention.

The insulation piercing pieces 10A and 10B are made up of an insulation piercing plate 30 which is bent substantially perpendicularly at each longitudinal end of the bottom plate 26. The insulation piercing conductive section 24 comprises a bottom plate 26, laid on the substrate 25, and an insulation piercing plate 30 formed at each end. More specifically, the bottom plate 26 is extended from one edge of the substrate 25, and it is folded over the substrate 25 along a folding line (F) shown in FIG. 4. Each of the insulation piercing plates 30 has a pair of right and left blades 11 which define an insulation piercing slot 12 which is extended downwardly from the top end. That is, the roots of each pair of right and left insulation piercing blades are located near the bending line (L) shown in FIG. 4.

Reinforcing walls 32 are provided at both ends of each of the bending lines to prevent the insulation piercing blades 11 from being bent in a direction along the longitudinal axis of the bottom plate 26. In one embodiment, the reinforcing walls 32 are flat portions which are formed by obliquely punching both ends of each of the bending lines with respect to the insulation piercing pieces 10A and 10B and the bottom plate 26.

Figure 1:
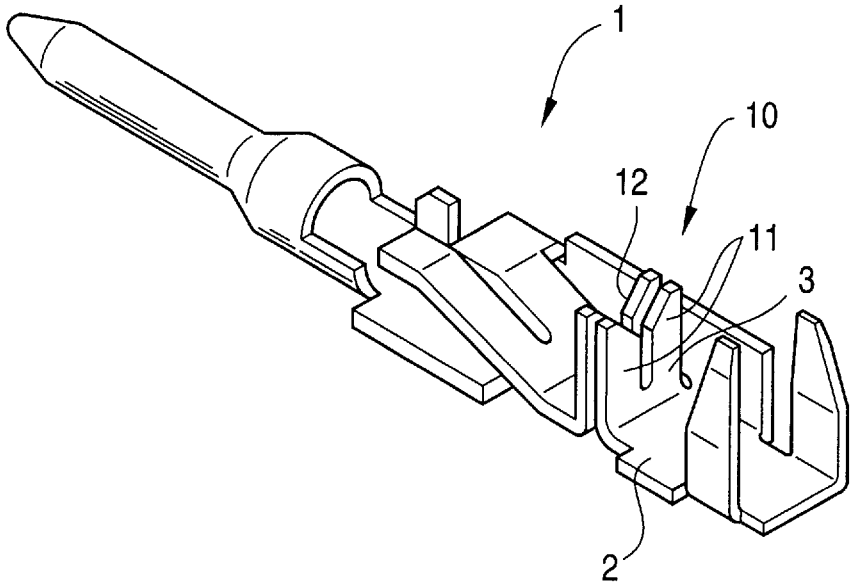
FIG. 1 PRIOR ART
FIG. 1 is a perspective view of a conventional insulation piercing terminal.
Figure 2:
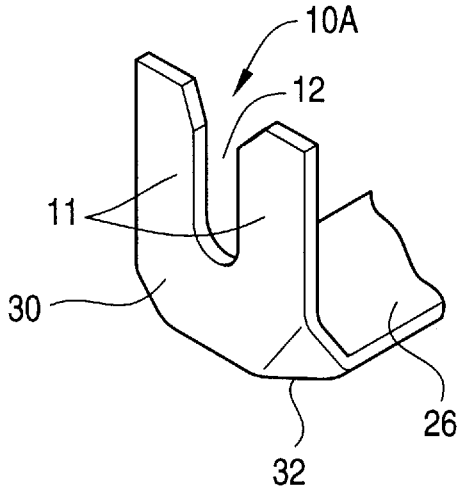
FIGS. 2(*a*)–2(*c*) show examples of an insulation piercing plate in an insulation piercing terminal according to the invention, more specifically, FIG. 2(*a*) is a perspective view showing an example of an insulation piercing plate of the insulation piercing terminal in which reinforcing walls relatively low in height are provided at both ends of a bending line of the insulation piercing plate, FIG. 2 (*b*) is a perspective view shown of another example of the insulation piercing plate of the insulation piercing terminal in which reinforcing walls relatively high in height are provided at both ends of a bending line of the insulation piercing plate, and FIG. 2(*c*) is a perspective view of another example of the insulation piercing plate which has ideal reinforcing walls.
Figure 2:
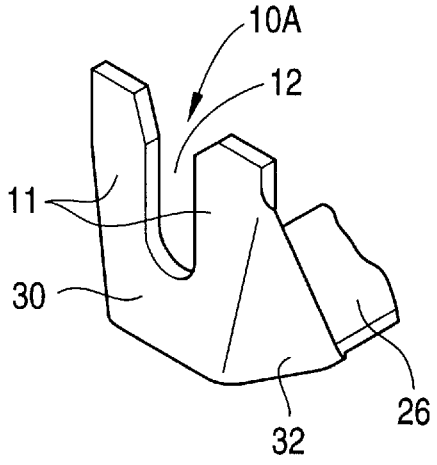
Figure 2:
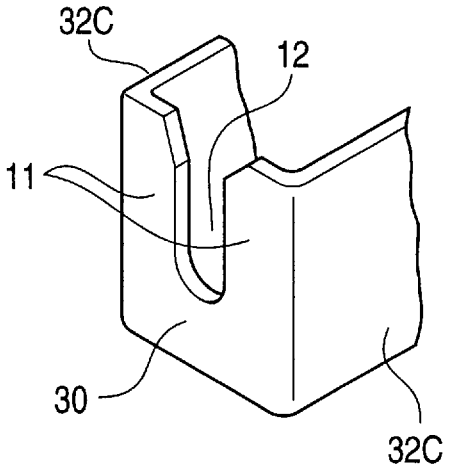

FIG. 2(*a*) and FIG. 2(*b*) show first and second examples of the reinforcing wall 32, respectively. The first example of the reinforcing wall 32 shown in FIG. 2(*a*) is in the form of a triangle relatively low in height, while the second example of the reinforcing wall 32 shown in FIG. 2(*b*) is in the form of a triangle relatively high in height. The reinforcing wall 32 shown in FIG. 2(*b*) is higher in reinforcing effect than the one shown in FIG. 2(*a*). Ideally, both ends of each of the bending line are punched into side walls 32*c* as shown in FIG. 2(*c*).

As shown in FIGS. 3(*a*)–3(*c*), the insulation piercing conductive section 24 has a side wall 27. The side wall 27 is formed by bending upwardly a plate which is extended from the other edge of the substrate 25. The side wall 27 has grooves 28, which are engaged with first edges of the insulation piercing pieces 10A and 10B, so that the insulation piercing pieces 10A and 10B, are prevented from falling in a longitudinal direction of the substrate 25.

The function of the insulation piercing terminal thus constructed will be described.

The insulation piercing terminal 21 is connected to a wire as follows: One end portion of the wire is laid on the rear end portion of the insulation piercing terminal 21 in such a manner that the one end portion of the wire is in parallel with the rear end portion of the insulation piercing terminal 21. Under this condition, the wire is pushed in the insulation piercing slots 12 of the insulation piercing conductive section 24 from above. As a result, the right and left insulation piercing blades 11 of each insulation piercing plate 30 cut the insulating sheath of the wire, and contact the conductor of the wire. When the wire is further pushed in the insulation piercing slots 12, the conductor is caused to go into a space between the right and left insulation piercing blades 11, thus being positively held by the right and left insulation piercing blades 11.

In the above-described operation, force acts to push the right and left insulation piercing blades 11 along the longitudinal axis of the terminal 21; however, the right and left insulation piercing blades 11 are prevented from such movement, because the reinforcing walls 32 are provided at both ends of each of the bending lines of the insulation piercing blades 11 to reinforce the roots of the insulation piercing blades 11. Hence in the case where the width of the insulation piercing blades is decreased to miniaturize the insulation piercing terminal, the insulation piercing terminal of the invention is free from the difficulty of unsatisfactory insulation piercing caused by the insulation piercing blades 11 not remaining in place when the wire is pushed in the insulation piercing slots. In addition, the invention allows the contact load (or holding load) on the conductor of the wire to be high enough so that the electrical connection is improved in reliability. Both ends of the intersections of the bottom plate 26 and the insulation piercing pieces 10A and 10B can be obliquely punched to form the reinforcing walls 32, which readily and positively reinforce the roots of the insulation piercing blades 11.

As was described above, in the insulation piercing terminal according to the first aspect of the invention, the reinforcing walls are provided at both ends of each of the bending lines to prevent the insulation piercing blades from being bent in a direction along the longitudinal axis of the bottom plate 26. Hence, when a wire is pushed in the insulation piercing slots, force acts to bend the crimping blades in a direction along the longitudinal axis of the bottom substrate, however, the insulation piercing blades are prevented from such movement. Therefore, in the case where the width of the insulation piercing blades is reduced in size to miniaturize the insulation piercing terminal, the difficulty of unsatisfactory piercing is eliminated when the wire is pushed in the insulation piercing slots. And the contact load (or hold load) on the conductor of the wire is high enough so that the electrical connection is improved in reliability.

In the insulation piercing terminal according to the second aspect of the present invention, the reinforcing walls are formed by punching at both ends of each of the bending lines. Therefore, the roots of the insulation piercing blades are readily and positively reinforced; that is, the insulation piercing blades are prevented from being displaced.

In the insulation piercing terminal according to the third aspect of the present invention, the reinforcing walls are formed oblique with respect to the insulation piercing plate and the bottom plate by punching both ends of the line of intersection of the insulation piercing plate and the bottom plate. Hence, the roots of the insulation piercing blades are readily and positively reinforced; that is, the insulation piercing blades are prevented from being displaced.

The insulation piercing terminal according to the fourth aspect of the present invention has the following effects or merits in addition to those of any one of first to third aspects.

In the insulation piercing terminal according to the fourth aspect of the present invention, the bottom plate, of the insulation piercing conductive section, is extended from one edge of a substrate, and folded over the substrate. Hence, on the continuous common substrate, the electrical contact section, the insulation piercing conductive section, and the wire cramping section can be arranged in the stated order. The insulation piercing terminal can be manufactured with ease, and is simple in structure, and high in mechanical strength.

The insulation piercing terminal according to the fifth aspect of the present invention has the following effects or merits in addition to those of the insulation piercing terminal according to the fourth aspect.

In the insulation piercing terminal according to the fifth aspect, the grooves formed in the side wall of the insulation piercing conductive section are engaged with the side edges of the insulation piercing plates, which prevent the insulation piercing plates from falling aside; that is, the wire can be positively connected to the insulation piercing terminal.

While there has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An insulation piercing terminal formed by pressing a piece of thin metal plate comprising:

a bottom plate extended in a longitudinal direction;

an insulation piercing plate directly connected to said bottom plate, said insulation piercing plate having right and left insulation piercing blades which are bent raised along with a bending line against said bottom plate; and reinforcing walls provided at both ends of said bending line to prevent said right and left insulation piercing blades from being displaced.

2. An insulation piercing terminal as claimed in claim 1, in which each of said reinforcing walls includes a flat surface portion which is formed at both ends of said bending line.

3. An insulation piercing terminal as claimed in claim 2, in which each of said reinforcing walls includes a flat surface portion which is oblique with respect to said crimping plate and said bottom plate.

4. An insulation piercing terminal comprising:

an elongated substrate having one edge portion from which a bottom plate is extended;

an electrical contact section connected to the front end portion of said substrate in a longitudinal direction for engaging with a mating terminal; and a cramping plate connected to the rear end portion of said substrate in said longitudinal direction for cramping a wire;

wherein said bottom plate is folded over said substrate, a pair of insulation piercing plates are respectively connected to the longitudinal ends of said bottom plate, each of said insulation piercing plates is provided with right and left insulation piercing blades so as to define an insulation piercing slot therebetween, each of said insulation piercing plates is raised along a bending line against said bottom plate so as to form an insulation piercing conductive section between said electrical contact section and said wire cramping section, and reinforcing walls are provided at both ends of said bending line to prevent said right and left insulation piercing blades from being displaced.

5. An insulation piercing terminal as claimed in claim 4, in which each of said reinforcing walls includes a flat surface portion which is formed at both ends of said bending line.

6. An insulation piercing terminal as claimed in claim 5, in which each of said reinforcing walls includes a flat surface portion which is oblique with respect to said insulation piercing plate and said bottom plate.

7. An insulation piercing terminal as claimed in claim 4, in which said substrate is provided with a support plate which is extended from the other edge thereof and is bent upwardly to form a side wall of said crimping conductive section, and said support plate defining said side wall is formed with grooves which are engaged with the side edges of said insulation piercing plates.

8. An insulation piercing terminal as claimed in claim 1, wherein:

said reinforcing walls are formed by punching.

9. An insulation piercing terminal as claimed in claim 4, wherein:

said reinforcing walls are formed by punching.

* * * * *